United States Patent [19]

Biber

[11] 4,246,449

[45] Jan. 20, 1981

[54] ELECTROSTATIC TRANSDUCER HAVING OPTIMUM SENSITIVITY AND DAMPING

[75] Inventor: Conrad H. Biber, Needham, Mass.

[73] Assignee: Polaroid Corporation, Cambridge, Mass.

[21] Appl. No.: 32,951

[22] Filed: Apr. 24, 1979

[51] Int. Cl.[3] ..... H04R 19/00

[52] U.S. Cl. ..... 179/111 R

[58] Field of Search ..... 179/111 R, 111 E, 106, 179/110 A, 110 B, 110 D, 115 R, 124, 128, 138, 140, 181 R; 128/653, 660; 310/313

[56] References Cited

U.S. PATENT DOCUMENTS

| | | | |
|---|---|---|---|
| 4,081,626 | 3/1978 | Muggli et al. | 179/111 R |
| 4,085,297 | 4/1978 | Paglia | 179/111 R |
| 4,147,425 | 4/1979 | Friedman et al. | 354/304 |

*Primary Examiner*—Thomas A. Robinson

*Attorney, Agent, or Firm*—John J. Kelleher

[57] ABSTRACT

Optimum damping and sensitivity for a combination transmitting and receiving capacitance type, electrostatic transducer are provided, by forming lands and indents, of a controlled number and size, on the crests of spaced apart projections on the relatively inflexible backplate of said transducer.

4 Claims, 6 Drawing Figures

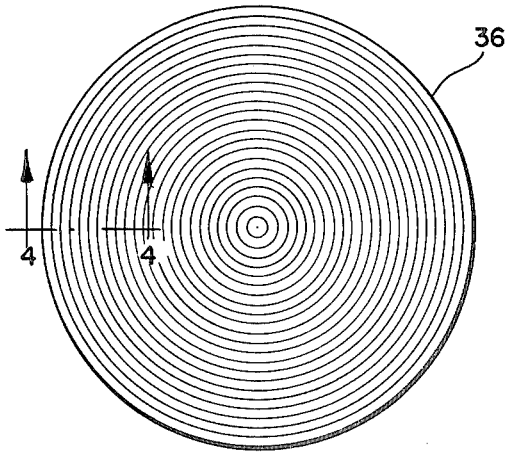
FIG. 3
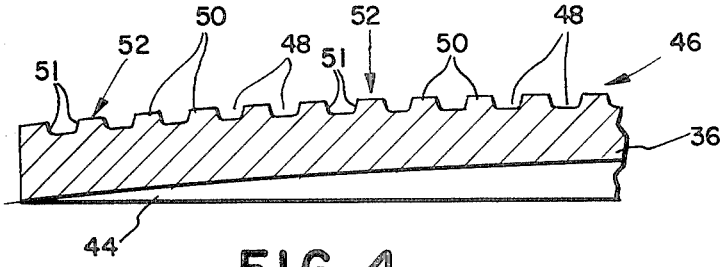
FIG. 4
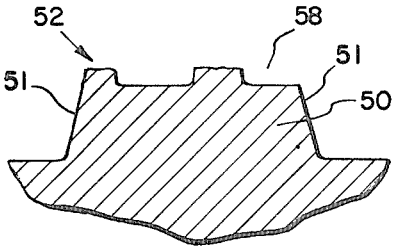
FIG. 6
FIG. 5
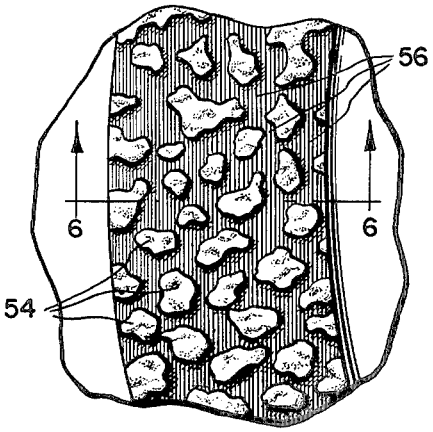

ELECTROSTATIC TRANSDUCER HAVING OPTIMUM SENSITIVITY AND DAMPING

BACKGROUND OF THE INVENTION

1. Field of the Invention

The present invention relates to combination transmitting and receiving, capacitance type, electrostatic transducers capable of transmitting and receiving an ultrasonic object detection signal in general, and to such transducers for use with ultrasonic range-finding systems, in particular.

2. Description of the Prior Art

Ultrasonic ranging systems for focusing the lens of a photographic camera have been disclosed in the prior art. Copending patent application Ser. No. 3,371, filed Jan. 15, 1979, by J. MUGGLI, discloses a ranging system for focusing the adjustable focus lens of a camera in response to the transmission and reception of a single burst of multiple frequency, ultrasonic energy. This arrangement enables a camera operator to sequentially range, focus and actuate a camera's shutter mechanism in a relatively short period of time, as compared to human reflux time, in response to the manual depression of a shutter release button.

The ranging system disclosed in the above-cited application utilizes a combination transmitting and receiving, capacitance type, electrostatic transducer for both transmitting and receiving the multiple frequency burst of ultrasonic energy mentioned above. To be practical for use in camera focusing however, the transducer in such a camera ranging system must have a high mechanical damping factor in order to insure rapid decay of transducer diaphragm vibrations after termination of a transmit or transducer drive signal before an echo of said transmit signal reaches said transducer. A transducer diaphragm that continues to vibrate or "ring" for an excessive period of time after the termination of a transmit signal will erroneously appear to be a true echo of said transmit signal to said camera ranging system, which may result in camera lens misfocusing. As a result of this "ringing" phenomenon, the closest object detection distance of such a system is dependent upon the time required for the vibrations of a vibrating transducer diaphragm to decay after a transmit or transducer drive signal has been terminated.

A capacitance type electrostatic transducer capable of transmitting ultrasonic energy and sensing a reflection or echo of said transmitted energy is described in U.S. Pat. No. 4,081,626 to MUGGLI, et al. In such a transducer, a thin plastic film, metallized on one surface to form an electrode, is stretched over a relatively massive metallic counter-electrode, hereinafter termed the backplate, with the non-conductive surface of said film in contact with said backplate. The metallized surface of the film separated by the insulating film from the backplate defines a capacitor such that when a dc bias voltage is applied across the electrodes of this capacitor, irregularities on the surface of the backplate set up localized concentrated electric fields in the film. When a signal is superimposed on the dc bias during a transmission mode of operation, the film is stressed and oscillatory formations develop causing ultrasonic energy or an "acoustical" wavefront to be propagated from the film with its metallized surface, said combination also being referred to herein as a diaphragm. During the receive mode, variable ultrasonic pressure waves on the diaphragm deform the insulating film, thereby producing a variable voltage across said electrodes.

In the above-cited MUGGLI et al. patent, it is noted that transducer sensitivity to an echo of an ultrasonic pressure wave is improved by reducing transducer capacitance and that one way to reduce transducer capacitance is by sandblasting or roughening the transducer backplate surface that would otherwise contact the transducer diaphragm. For transducer capacitance repeatability in high volume transducer manufacturing operations, said MUGGLI et al. patent also describes a transducer backplate, diaphragm-contact surface having uniform striations.

A sandblasted or uniformly striated transducer backplate, diaphragm-contact surface will reduce transducer capacitance and improve transducer sensitivity as explained in said MUGGLI et al. patent. However, Applicant has observed that as the diaphragm-to-transducer contact surface is reduced by such surface texturing, for the purpose of increasing transducer sensitivity, etc., the time required for the vibrations of the transducer diaphragm to decay, after the termination of a transmit signal, increases. As noted above, for reliable distance measuring, increased vibration time or "ringing" necessarily increases the minimum object detection distance of a range finder system having a combination transmitting and receiving electrostatic transducer of the type described above.

SUMMARY OF THE INVENTION

In accordance with the teachings of the present invention, a combination transmitting and receiving, capacitance type electrostatic transducer having optimum sensitivity and damping is provided. The transducer includes a relatively inflexible backplate having at least one major surface thereof formed of conductive material, a layer of insulative material disposed across said major surface of said backplate, and a relatively flexible layer of conductive material in tight contact with said layer of insulative material. The major backplate surface is defined by a series of projections spaced apart by intervening grooves and the crests of said projections define continuous imaginary curved or planar surfaces comprised of a multiplicity of lands and indents with said lands having a mean diameter on the order of between 0.0002 and 0.001 inch and the area of said imaginary surfaces displaced by said indents being on the order of between 50 to 70% of the total of said imaginary surfaces. By controlling the number and size of said lands and indents, as specified above, optimum decay of the vibrations of said conductive and/or insulative layer, and sensitivity to an ultrasonic pressure wave impinging on said conductive and/or insulative layer, will result.

BRIEF DESCRIPTION OF THE DRAWINGS

FIG. 3 is a top view of the transducer backplate in the electrostatic transducer assembly of FIGS. 1 and 2.

FIG. 4 is an enlarged sectional view, in elevation, taken along the line 4—4 in FIG. 3.

FIG. 5 is a greatly magnified top view of lands and indents on a surface forming a crest on, for example, any one of the transducer backplate projections of FIG. 4.

FIG. 6 is an elevational view taken along the line 6—6 in FIG. 5.

DESCRIPTION OF THE PREFERRED EMBODIMENT

Figure 1:
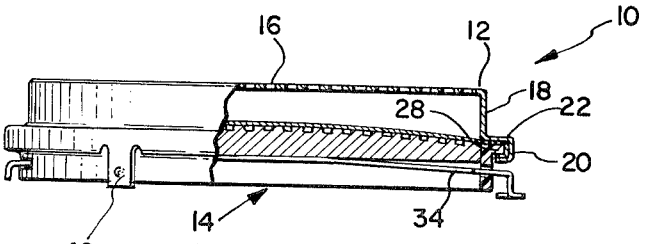
FIG. 1 is an elevational view, partly in section, of an electrostatic transducer assembly incorporating the optimum sensitivity and damping concept of the present invention.
Figure 2:
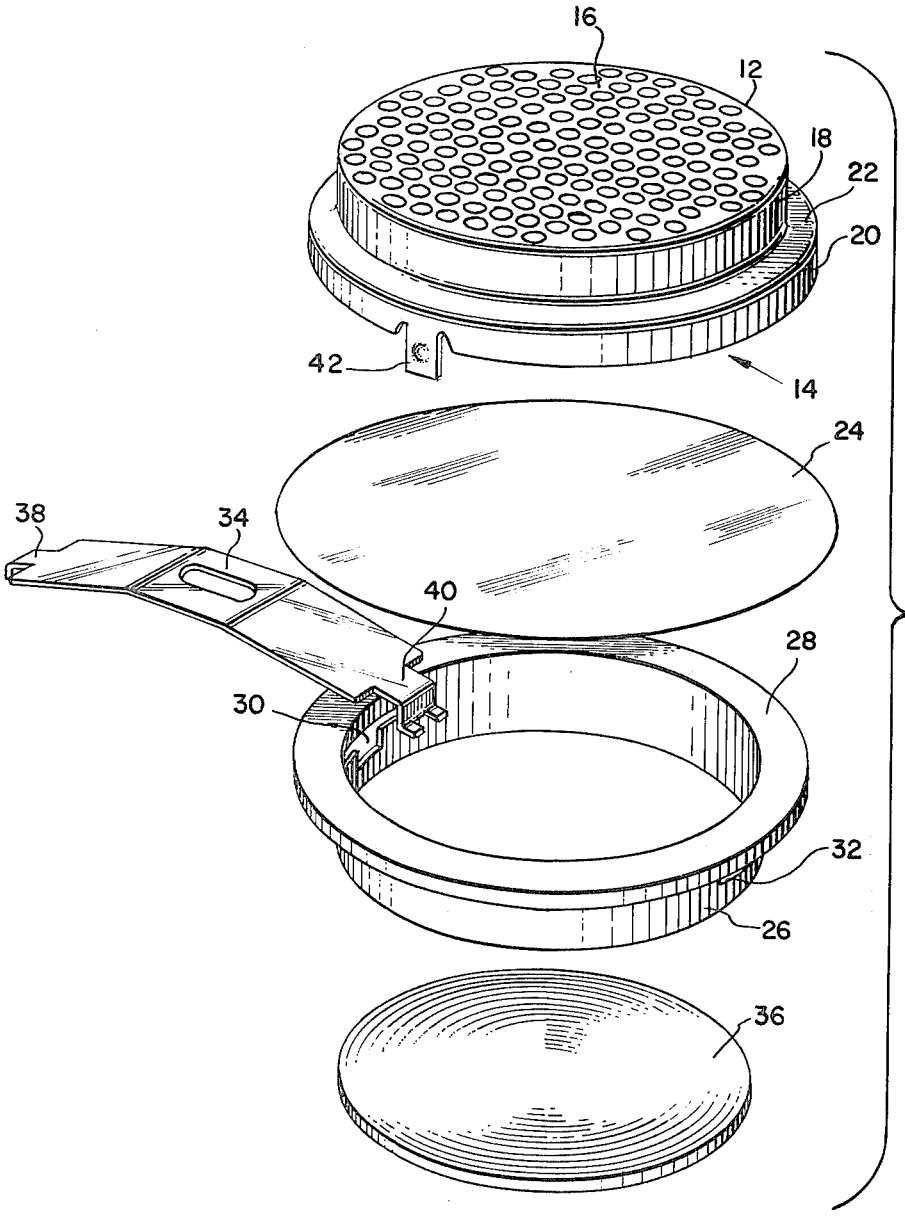
FIG. 2 is an exploded perspective view of the electrostatic transducer assembly of FIG. 1.

Referring now to the drawings, and specifically to FIGS. 1 and 2, reference numeral 10 designates an electrostatic transducer assembly incorporating a preferred embodiment of the inventive concept of the present invention. FIG. 1 is an elevational view, partly in section, of transducer assembly 10 fully assembled; and FIG. 2 is an exploded perspective view of said transducer assembly 10. Transducer assembly 10 includes cover 12, of circular cross section, having open end 14 and screen end 16, said cover 12 having two cylindrical portions 18 and 20, of different cross section diameters, with shoulder portion 22, intermediate of said two cylindrical portions, lying in a plane that is parallel to the screen in screen end 16 of cover 12.

Circular diaphragm 24 is formed of a relatively thin plastic dielectric film material, such as the film material sold under the trade name Kapton or the like, with said film material being metallized on one side.

Plastic inner ring 26 which is the main support housing of transducer 10 is of cylindrical shape, of circular cross section and has flange 28 extending laterally outward from one end thereof. A pair of T-shaped spring mounting slots 30, 32, for mounting and retaining diaphragm tensioning spring 34, project through the cylindrical wall of said housing 26 and are located diametrically opposite from one another on the wall of said housing 26.

Diaphragm 24 is inserted into open end 14 of cover 12 with its metallized surface facing screen end 16 of said cover 12 to the point where an annular region of said diaphragm 24 rests on shoulder portion 22. Flanged end 28 of inner ring 26 is then inserted into said open end 14 of cover 12 to the point where said flanged end 28 uniformly presses on the non-metallized surface of diaphragm 24. The periphery of diaphragm 24 and flanged end 28 of inner ring 26 are then placed in a fixed relation with respect to cover 12 by crimping or bending the open end of cover 12 until said diaphragm periphery and inner ring flange 28 are fixedly sandwiched between shoulder portion 22 of cover 12 and the bent or crimped end of said cover 12.

Metallic backplate 36, a relatively massive and substantially inflexible circular disc, has a concave surface on one side and a convex surface with a multiplicity of concentric grooves on the side opposite said concave surface side. The reason for the convex surface of backplate 36 is to enhance subsequent, uniform contact with diaphragm 24. The convex surface of said backplate 36 with its multiplicity of grooves is the situs of the structural features embodying the inventive concept of the present invention, and therefore said curved surface will be described below in much greater detail.

Backplate 36, with its grooved convex surface facing diaphragm 24, is inserted through the non-flanged end of housing 26 and into contact with the non-metallized surface of said diaphragm 24. With backplate 36 maintained in contact with diaphragm 24, diaphragm tensioning leaf spring 34 is inserted through T-shaped slots 32, 30 to the point where tongue-like ends 38, 40 spring down into the vertical portions of said T-shaped slots 30, 32 wherein said leaf spring 34 becomes trapped within the cylindrical wall of housing 26, a position where it maintains backplate 36 in contact with diaphragm 24 and provides the proper tensioning of said diaphragm 24.

As explained above in the above-cited MUGGLI, et al. patent, a range finding system of the type described in the afore-mentioned application Ser. No. 3,371 provides a dc bias voltage and an ac signal to the metallized surface diaphragm 24 through connection 42 on metallic cover 12 and to metallic backplate 36 through the connector end of leaf spring 34 causing ultrasonic energy to be transmitted toward an object for object detection purposes. A reflection or echo of this transmitted signal impinging on the transducer 10 will cause an object detection signal to appear between connector 42 on cover 12 and the connector end of leaf spring 34. This object detection signal is utilized by the remainder of the range finding system to determine object distance.

Irregularities on, for example, the convex transducer backplate surface that contacts the transducer diaphragm are necessary for proper transducer 10 operation, as previously discussed. Within limits, a reduction in this diaphragm-to-backplate contact surface will increase transducer sensitivity to, for example, relatively low level reflected ultrasonic energy. However, when the actual diaphragm-to-backplate contact area is reduced below a particular percentage of the total potential diaphragm-to-backplate contact area, the transducer diaphragm vibrates or "rings" for an excessively long period of time after termination of the transducer diaphragm drive force, before said vibrations decay. This excessive decay time necessarily increases minimum object detection distance because of the inability of the range finding system to distinguish between a detection signal generated by the detection of an object, and a signal generated by a vibrating or "ringing" diaphragm. The design of backplate 36 and transducer assembly 10 is one that minimizes transducer "ringing" while maximizing transducer sensitivity to, for example, relatively low level ultrasonic energy. The details of the design of backplate 36 are shown in FIGS. 3–6.

FIG. 3 is a top view of relatively inflexible backplate 36 of transducer assembly 10 of FIGS. 1 and 2. Backplate 36 is a disc-shaped member that is crowned on the side shown in that it is higher at the center of said backplate 36 than it is at its edge. The surface of the crowned side of backplate 36 includes a multiplicity of evenly spaced circular projections formed by a multiplicity of evenly spaced concentric grooves. Backplate 36 could be made of a non-conductive material with metallized surfaces, but is preferably made of aluminum. The concentric grooves and projections on the convex surface of backplate 36 are shown in FIG. 4 in much greater detail.

FIG. 4 is an enlarged sectional view, in elevation, of backplate 36 taken along the line 4—4 in FIG. 3. Backplate 36 in said FIG. 4 has concave surface 44 on one side and convex surface 46 on the side opposite said concave surface side 44. Convex surface 46 includes a multiplicity of concentric grooves 48 of substantially rectangular cross section, that form a multiplicity of uniformly spaced apart projections 50. In actual practice, sides 51 of grooves 48 have a draft angle of approximately 15 degrees so that a die forming said grooves 48 can be easily withdrawn from backplate 36. Backplate surfaces 44, 46 can be various combinations of planar, convex or concave, but are preferably the concavo-convex shape depicted in FIG. 4.

When transducer 10 (FIGS. 1 and 2) is fully assembled, the non-conductive surface of diaphragm 24 (FIGS. 1 and 2) is in contact with the projecting surfaces of crests 52 of said projections 50. When a crest 52 is microscopically viewed from the top in FIG. 4, said crest 52 has a texture that approximates that shown in FIG. 5. FIG. 6, which is a view taken along the line 6—6 in FIG. 5, shows the approximate texture of said crest 52, in elevation.

Referring now to FIGS. 5 and 6, crest 52 is formed of a multiplicity of minute lands 54, and indents 56 wherein said lands have a mean diameter on the order of between 0.0002 and 0.001 inch and the area of an imaginary surface 58 displaced by said indents being on the order of between 50 and 70% of the total of said imaginary surface 58. All points on that surface of lands 54 on crests 52 ideally, but not actually, formed to the contour of imaginary surface 58 should be no further than 0.0002 inch away from said imaginary surface 58. The lands on crests 52 are seldom, if ever, circular and therefore the term "mean diameter" used herein with respect to such lands means the mean diameter of circles having an area equal to the crest area of lands on said crests 52. The imaginary surface as used herein means the total convex surface (or planar surface if said convex surface of backplate 36 was planar instead of convex) of the crest 52 of projections 50 before any indents 56 are made in said crest 52. The reason for defining an imaginary surface is to facilitate describing the lands and indents forming said crests 52.

Indents 56 on the crests 52 of backplate 36 can be formed by the conventional, well-known process of electrical discharge machining (EDM). The EDM process consists of directing a series of very high frequency spark discharges from a soft metal tool, operating as an electrode, to disintegrate hard materials for the purpose of forming cavities. Holes of almost any shape can be made to close tolerances. The spark discharge passes through the space between the tool and the workpiece, which is filled with a dielectric liquid, and vaporizes a small portion of the workpiece as the electrode advances.

The land and indent dimensions specified above can be more accurately formed on the crests of projections 52 of backplate 36 when said backplate is directly machined by, for example, the above-described EDM process. However, such a technique is relatively expensive in high volume manufacturing operations. Transducer backplates having a textured surface, as specified above, can be formed in a die press coining operation employing a die having a surface that is the complement of the desired textured surface. Backplate metal-flow problems are created when a coining operation is employed. However, this problem can be compensated for by such expedients as varying the pressure applied to the die when the textured surface of said die is being impressed on the backplate, and by initially forming deeper grooves 48 in backplate 36 that subsequently fill with flowing backplate metal as the backplate is being textured.

A combination transmitting and receiving electrostatic transducer having a backplate with lands and indents on the crests of its diaphragm contacting projections, as described above, that are within the range of land and indent dimensions specified above, will have the capability of optimally detecting relatively close objects and relatively low level ultrasonic energy reflected from, for example, distant objects.

It will be apparent to those skilled in the art from the foregoing description of my invention that various improvements and modifications can be made in it without departing from its true scope. The embodiment described herein is merely illustrative and should not be viewed as the only embodiment that might encompass my invention.

What is claimed is:

1. An electrostatic transducer comprising a relatively inflexible backplate having at least one major surface thereof formed of conductive material, a layer of insulative material disposed across said major surface of said backplate, and a relatively flexible layer of conductive material in tight contact with said layer of insulative material and disposed across the surface thereof remote from said backplate, said major surface being defined by a series of projections spaced apart by intervening grooves, the crest of said projections defining a substantially continuous imaginary curved or planar surface but comprising a multiplicity of lands and indents with said lands having a mean diameter on the order of between 0.0002 and 0.001 inch and the area of said imaginary surface displaced by said indents being on the order of between 50 to 70% of the total of said imaginary surface.

2. The transducer of claim 1 wherein said lands lie no greater than substantially 0.0002 inch from said imaginary surface.

3. The transducer of claim 1 wherein said indents are formed in said crests by directing a series of very high frequency spark discharges from a soft metal tool onto said backplate.

4. The transducer of claim 1 wherein said indents are formed in said crests by a die press coining operation employing a die having a textured coin surface formed by directing a series of very high frequency spark discharges from a soft metal tool onto said die.

* * * * *